US007987906B1

(12) United States Patent
Troy

(10) Patent No.: US 7,987,906 B1
(45) Date of Patent: Aug. 2, 2011

(54) WELL BORE TOOL

(76) Inventor: Joseph Troy, Spruce, MI (US)

( * ) Notice: Subject to any disclaimer, the term of this patent is extended or adjusted under 35 U.S.C. 154(b) by 309 days.

(21) Appl. No.: 12/316,565

(22) Filed: Dec. 15, 2008

Related U.S. Application Data

(60) Provisional application No. 61/008,467, filed on Dec. 21, 2007.

(51) Int. Cl.
*E21B 37/00* (2006.01)
*E21B 29/02* (2006.01)

(52) U.S. Cl. ..... 166/222; 166/153; 166/177.3; 166/311; 166/376

(58) Field of Classification Search ..... 166/222, 166/153, 177.3, 376, 311, 312, 170, 174, 166/173
See application file for complete search history.

(56) References Cited

U.S. PATENT DOCUMENTS

| | | | |
|---|---|---|---|
| 2,660,250 | A | 11/1953 | Gage et al |
| 3,324,389 | A | 6/1967 | Blank, Jr. |
| 4,838,354 | A | 6/1989 | Jenkins |
| 5,076,365 | A | 12/1991 | Jenkins |
| 5,447,200 | A | 9/1995 | Dedora et al. |
| 5,709,269 | A | 1/1998 | Head |
| 6,039,117 | A | 3/2000 | Mueller |
| 6,651,744 | B1 | 11/2003 | Crawford |
| 7,011,158 | B2 | 3/2006 | Davis et al. |
| 2004/0060998 | A1 | 4/2004 | Stoecklein et al. |
| 2005/0051335 | A1 | 3/2005 | Davis et al. |
| 2006/0086507 | A1 | 4/2006 | Surjaatmadja et al. |

*Primary Examiner* — Giovanna C Wright
(74) *Attorney, Agent, or Firm* — Harpman & Harpman

(57) ABSTRACT

A gas insertion tool for cleaning a well bore is connected to the down hole end of a fluid supply tubing inserted through a positioning string within a well bore. Fluid pressure within the string pushes the well tool therethrough pulling the fluid supply line and then exiting the well string within the well bore adjacent its termination. The positioning string is retrieved leaving the tool wedgeably secured within the well bore for dispensing pressurized fluid within the well bore dislodging fluid and trapped foreign material within the horizontal leg of the well bore.

9 Claims, 3 Drawing Sheets

WELL BORE TOOL

This application claim benefit of U.S. Provisional Application No. 61/008,467, filed Dec. 21, 2007.

BACKGROUND OF THE INVENTION

1. Technical Field

This invention relates to well drilling and production industry, specifically the removal of foreign material that accumulates in the well bore and specifically in the horizontal portion of the well bore typical in current well drilling methodology.

2. Description of Prior Art

A variety of prior art devices have been developed for insertion and cleaning of well bores, see for example U.S. Pat. Nos. 3,324,389, 5,709,269, 2,660,250, 4,838,354, 5,076,365, 5,447,200, 6,039,117, 6,651,744, 7,011,158 and U.S. Publications 2004/0060998, 2005/0051335 and 2006/0086507.

Prior art patents have bore engagement features for stabilization and cleaning; see patents ending in 117 and 764. Clean-out devices of insertion tool configurations include rotary cleaning heads such as seen in patent ending in 200 and fluid jets are shown in a nozzle configuration in patent ending in 158 and U.S. Publications ending in 698 and 507.

SUMMARY OF THE INVENTION

A well insertion clean-out and maintenance tool for removal of fluid trapped within the horizontal leg of a well bore so production product can be delivered to the surface. Typically, in horizontal wells foreign materials accumulates in this section and it is critical to maintain a free flowing passageway. The well bore tool of the invention combines a fluid pressure jet cleaning head with multiple well bore engagement stabilization arms that pivot outwardly upon deployment from a guide and delivery pipe string inserted and then removed from the well bore. Fluid pressure within the insertion string against multiple sealing flanges pushes the tool therethrough with an attached fluid clean-out supply tubing extending therefrom.

DETAILED DESCRIPTION OF THE INVENTION

Figure 1:
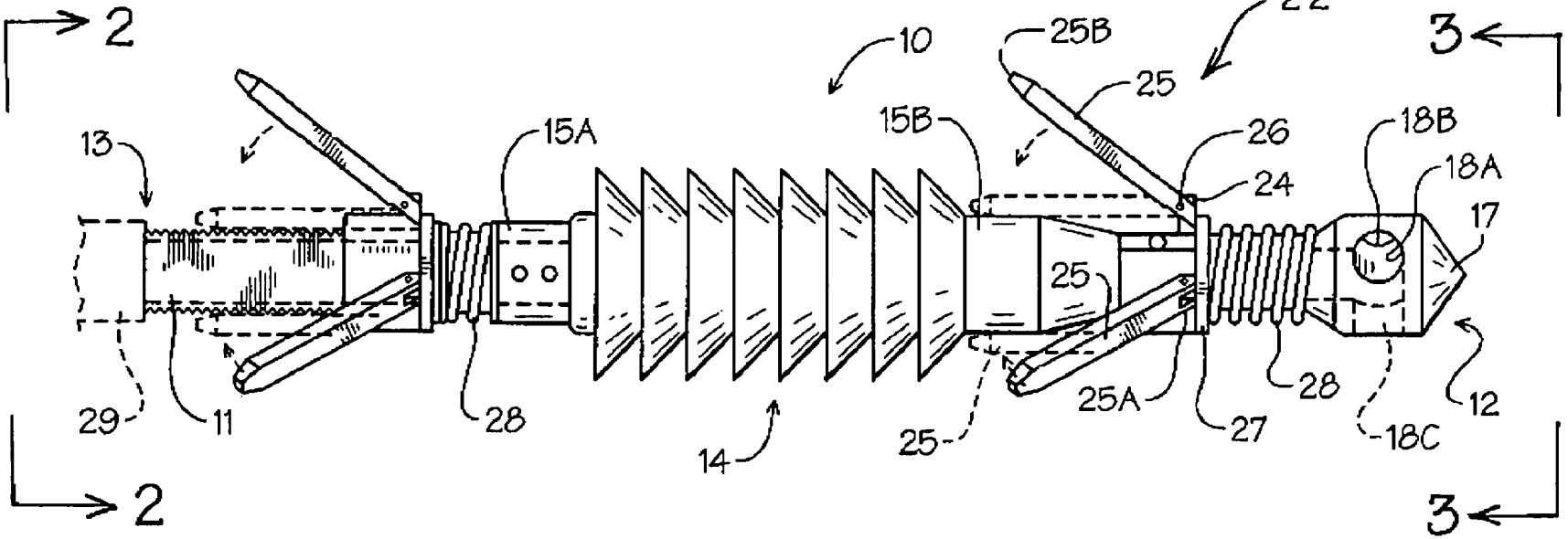
FIG. 1 is a side elevational view of the well bore tool of the invention.
Figure 4:
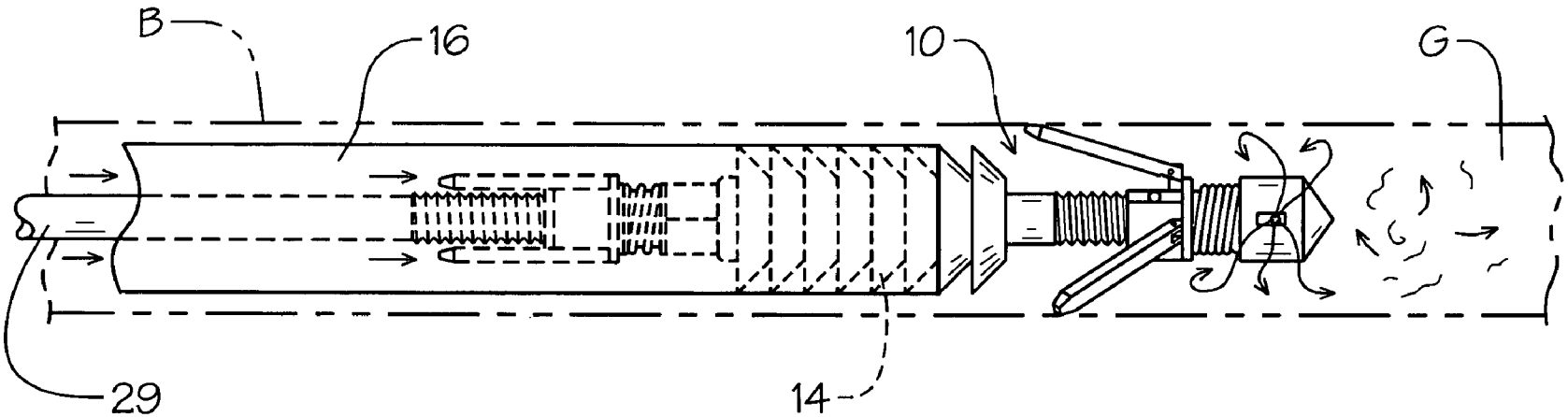
FIG. 4 is a side elevational view of the well bore tool being deployed from within replacement transport positioning string.

Referring to FIG. 1 of the drawings, the well bore tool 10 of the invention can be seen having a central externally threaded tubular supply housing 11 with an outlet end portion 12 and a supply retrieval end 13. A resilient cylindrical bellows seal fitting 14 is positioned midway on the supply housing 11 secured in place between a pair of retainment sleeves 15A and 15B. The flexible bellows seal fitting 14 provides for multiple sealing ring surface with the inside surface of a positioning and placement pipe string 16, as seen in FIG. 4 of the drawings, that is used to insert and deploy the well bore tool 10 within a well bore B as will be disclosed and described in greater detail hereinafter.

Figure 3:
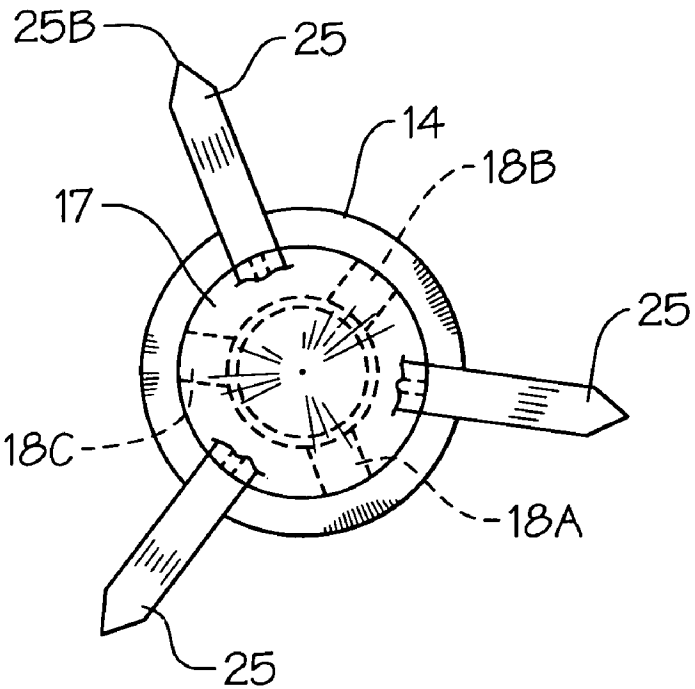
FIG. 3 is an end view on lines 3-3 of FIG. 1.
Figure 2:
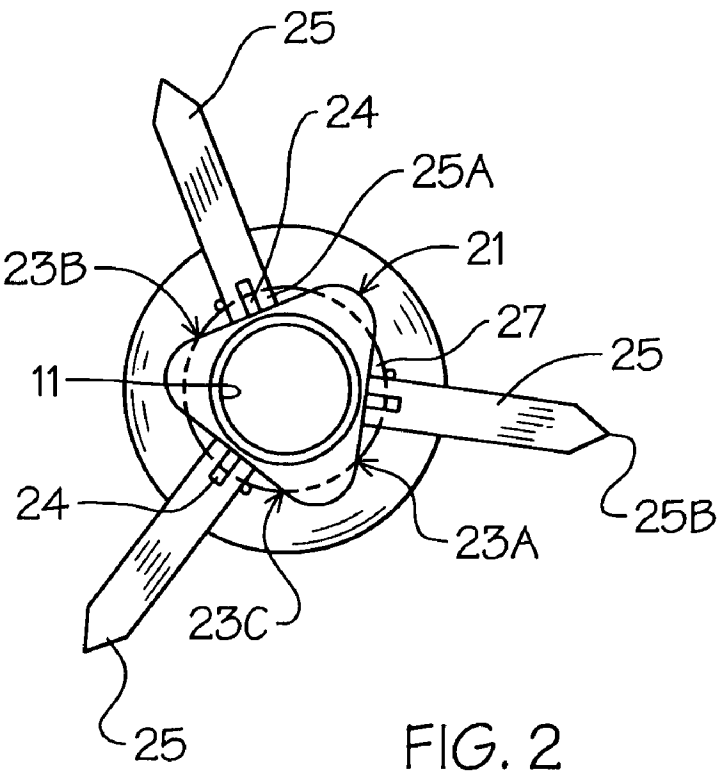
FIG. 2 is an end view on lines 2-2 of FIG. 1.

The outlet end portion 12 has a nozzle fitting 17 threadably disposed on an end of the supply housing 11. The nozzle fitting 17 has a central distribution manifold 18 within and multiple nozzle outwardly from the manifold to the external surface of the nozzle fitting 17 exiting and forming multiple outlet nozzle portals 18A, 18B and 18C as best seen in FIGS. 1 and 3 of the drawings.

A pair of stabilization and retainment assemblies 21 and 22 are threadably secured on the supply housing 11 with the assembly 22 in spaced relation to the nozzle fitting 17 and the assembly 21 in spaced relation to the hereinbefore described retainment sleeve 15A of the bellows seal fitting 14.

Each of the stabilization and retainment assemblies 21 and 22 have a triangular mounting sleeve fitting 23 defining multiple triangularly disposed planar mounting surfaces 23A, 23B and 23C thereon. Each of the mounting surfaces, in turn, has an upstanding apertured pivot lug 24 centrally positioned thereon adjacent one of its perimeter edges.

Multiple retainment engagement arms 25 are pivotally secured to each of the said mounting surface 23 with each arm having an apertured bifurcated end 25A and a pointed bore engagement end 25B. Each of the retainment engagement arms 25 are of a corrodible material and are pivotally engaged on the corresponding apertured pivot lug 24 by pivot retainment pin 26.

A spring urged arm deployment ring 27 abuts the pivot ends of the respective arms 25 having a spring 28 extending therefrom about the supply housing 11 through the nozzle fitting 17 on the outlet portion 12 and correspondingly through the bellows seal fitting retainment sleeve 15A. The respective springs 28 are under compression therebetween so that when the multiple arms 25 on the respective stabilization and restraint assemblies 21 and 22 fold down in longitudinal parallel relationship to the housing 11 which is required when the tool is positioned within the placement pipe string 16 as seen in FIG. 4 of the drawings.

In operation, the well bore tool 10 is attached to a poly or stainless steel tubing 29 for fluid supply to the bore tool 10's nozzle and frictionally inserted into the positioning and placement pipe string 16 that has been lowered down within the vertical bore portion, not shown, and into the horizontal bore portion B. Fluid, under pressure, either lift gas or liquid fluid such as water or brine is pumped into the pipe string 16 against the bellows seal 14 pushing the well bore tool 10 down the pipe string 16.

Once the well bore tool 10 reaches the end of the pipe string 16 which is pre-positioned just short of the well bore terminal end, it will be ejected therefrom as seen in FIG. 4 of the drawings and the operator (not shown) will know this has occurred by a drop in insertion fluid pressure. As the well bore tool 10 exits the pipe stringer 16 initially under the pressure, the arms 25 on the stabilization and retainment assembly 22 will pivot open under the influence of the spring urged deployment ring 27 and expand for engagement with the interior of the well bore B.

The pipe stringer 16 is then retrieved; leaving the well bore tool 10 deployed within the well bore B in spaced relation to its terminal end by the respective deployed retainment assemblies 21 and 22.

Lift gas G is then supplied in some applications to the attached supply tube 28 and is ejected through the nozzle portals 18A, 18B and 18C forming in the example application a pressure bubble in the end of the well bore B moving fluid trapped within the horizontal leg B of the well bore.

Additionally, the well bore tool 10 can be used to treat the well bore with cleaning solvents to remove paraffin or related debris that build up over production time.

To remove the well bore tool 10, acid is injected through the nozzle fitting 17 which will react with and dissolve the deployed retainment arms 25 which are made of aluminum in this application allowing the well bore tool 10 to be pulled free by the supply tubing 28 back out of the well bore B.

It will thus be seen that a new and novel well bore tool has been illustrated and described and it will be apparent to those skilled in the art that various changes and modifications may be made thereto without departing from the spirit of the invention. Therefore I claim:

The invention claimed is:

1. A down hole tool for cleaning a horizontal leg of a well bore comprising a tubular supply housing connected to a supply tubing, tool retainment assemblies on said supply housing, a bellows seal between said retainment assemblies, means for selectively disabling said tool retainment assemblies and a fluid dispensing fitting in communication with said supply housing and said supply tubing.

2. The down hole tool for cleaning a horizontal leg of a well bore of claim 1 wherein said tool retainment assemblies comprises, radially spaced, spring-urged pivoted engagement arms.

3. The down hole tool for cleaning a horizontal leg of a well bore set forth in claim 2 wherein said tool retainment assemblies further comprises, a spring-urged arm deployment ring frictionally engaged on the pivoted ends of said engagement arms.

4. The down hole tool for cleaning a horizontal leg of a well bore set forth in claim 2 wherein each of said engagement arms is formed from metal material having a known chemical reactive composition.

5. The down hole tool for cleaning a horizontal leg of a well bore set forth in claim 2 wherein said engagement arms are pivoted from a first position parallel with said supply housing to a second position registerably engaged within said well bore angularly disposed from the longitudinal axis of said supply housing.

6. The down hole tool for cleaning a horizontal leg of a well bore set forth in claim 1 wherein said bellows seal is sealingly engaged within a placement string pipe during positioning in said well bore.

7. The down hole tool for cleaning a horizontal leg of a well bore set forth in claim 1 wherein said fluid dispensing fitting has multiple nozzle fittings positioned radially thereabout.

8. The down hole tool for cleaning a horizontal leg of a well bore set forth in claim 1 wherein said means for selectively disabling said retainment assemblies comprise, chemical degradation of said retainment assemblies by material specific corrosive fluid through said supply tubing and tubing supply housing.

9. The down hole tool for cleaning a horizontal leg of a well bore set forth in claim 1 wherein said bellows seal is positioned on said tubular supply housing by oppositely disposed retainment sleeves secured to said tubular supply housing.

* * * * *